United States Patent [19]

Lepain

[11] Patent Number: 4,477,258

[45] Date of Patent: Oct. 16, 1984

[54] DIESEL FUEL COMPOSITIONS AND PROCESS FOR THEIR PRODUCTION

[75] Inventor: Andre O. Lepain, Rosieres-St-Andre, Belgium

[73] Assignee: Labofina, S.A., Brussels, Belgium

[21] Appl. No.: 202,277

[22] Filed: Oct. 30, 1980

[51] Int. Cl.[3] ..... C10L 1/32; C10L 1/18

[52] U.S. Cl. ..... 44/51; 44/53; 44/77

[58] Field of Search ..... 44/51, 53, 66, 77; 252/312, 308, 356

[56] References Cited

U.S. PATENT DOCUMENTS 3,876,391 4/1975 McCoy et al. ..... 44/51
4,002,435 1/1977 Wenzel et al. ..... 44/51
4,083,698 4/1978 Wenzel et al. ..... 44/51

*Primary Examiner*—Jacqueline V. Howard
*Attorney, Agent, or Firm*—Monty L. Ross; John K. Abokhair

[57] ABSTRACT

Stable diesel fuel emulsions of the water-in-oil type comprising from about 97 to about 90 volume percent of a mixture of a major amount of usual diesel fuel and a minor amount of at least about 5 volume percent of an aqueous solution of methanol, ethanol or a mixture thereof, and from about 3 to about 10 volume percent of an emulsifying blend of sorbitan monooleate and a water soluble, ethoxylated, non-ionic surfactant; and a process for producing such stable emulsions comprising adding while stirring the aqueous alcohol solution to a mixture of diesel fuel and emulsifying blend.

10 Claims, No Drawings

DIESEL FUEL COMPOSITIONS AND PROCESS FOR THEIR PRODUCTION

This invention relates to new Diesel fuel compositions and to a process for their production. More particularly, the invention relates to water-in-oil emulsions containing a Diesel fuel, an alcohol, water and an emulsifier.

The use of substitute fuels in order to reduce the consumption of crude oil has become of substantial importance in the last years. The research work in this field has been directed more particularly to the gasoline engines or engines with ignition by spark plugs. An attractive solution consists in using mixtures of gasoline and alcohols; methanol and ethanol can be mixed with gasoline in all proportions and they have a high octane number (about 87 to 90).

However, the incorporation of alcohols into Diesel fuels gives rise to some difficulties. It is known that a trouble free running of Diesel engines (or spontaneous ignition engines) requires the use of fuels with a cetane number of at least 26. But the cetane numbers of methanol and ethanol are low (respectively 3 and 8) and the cetane number of a Diesel fuel, more particularly gasoil and light fuel oil, is comprised between 34 and 55. Therefore, the range of mixtures containing a Diesel fuel and alcohol and exhibiting a suitable cetane number is relatively small. Moreover, methanol and ethanol are practically immiscible with the Diesel fuel and mixtures of these components cannot be prepared beforehand. The sole solution which has been suggested consists in using a bimodal feeding system. Such a system requires mechanical modifications, i.e. two tanks, a monitoring device for the alcohol, etc.

It is an object of this invention to provide Diesel fuel compositions which overcome these drawbacks. Another object is to provide stable, substitute fuels having a suitable cetane number. A further object is to provide water-in-oil emulsions containing a Diesel fuel and an alcohol. It is also an object of this invention to provide a process for producing these emulsions.

The combustible water-in-oil emulsions of the present invention comprise:

97 to 90 volume % of a mixture containing a major part of a Diesel fuel selected from the group consisting of gasoil and light fuel oil, and a lower amount of an aqueous solution of methanol and/or ethanol, and 3 to 10 volume % of an emulsifying blend containing sorbitan monooleate and a water-soluble, non ionic, ethoxylated surfactant.

According to an embodiment of this invention wherein gasoil is used as Diesel fuel, the emulsion comprises from 55 to 92 volume % of gasoil, from 5 to 35 volume % of an aqueous solution of alcohol, the volume percentage of water in said solution being comprised between $43+0.20$ S and 74, wherein S is the volume percentage of ethanol based on the total volume of alcohol, and 3 to 10 volume % of emulsifying blend.

According to another embodiment wherein light fuel oil is used as Diesel fuel, the emulsion comprises from 45 to 92 volume % of light fuel oil, from 5 to 45 volume % of an aqueous solution of alcohol, the volume percentage of water in said solution being comprised between $46.7+0.229$ S and 74.3, wherein S is the volume percentage of ethanol based on the total volume of alcohol, and 3 to 10 volume % of emulsifying blend.

The alcohol is preferably methanol or ethanol or their mixtures. These alcohols may contain a low amount of another aliphatic alcohol with a low molecular weight or of a denaturating agent such as methyl ethyl ketone. Consequently, denaturated alcohols containing generally up to 3% of denaturating agent may be used in the compositions of this invention.

These new compositions are stable water-in-oil emulsions, which exhibit a low viscosity and a suitable cetane number. Therefore, they can be used as substitute fuels for Diesel engines and for heating purposes. Moreover, they are stable and they do not give rise to a demixing and a settling of water in bottom of the tanks; a settling of water is a serious drawback, as said water would be first injected into the engine or the burner and would cause its breakdown. The term "stable emulsion" is understood to mean that practically no demixing occurs during a period of time of at least 72 hours; a ring of Diesel fuel may however appear, inasmuch that the amount of demixed fuel is not higher than 3 volume % of the fuel present in the emulsion. In case of demixing, the emulsion is easily restored by stirring.

The stability of the emulsions of this invention depends upon many factors, such as type of Diesel fuel, nature and amount of emulsifying agent, HLB (hydrophilic-lipophilic balance) of the emulsifying blend, respective amounts of alcohol and water, type of alcohol, mode of preparation.

When the emulsion is used to feed Diesel engines, the upper amount of aqueous solution of alcohol in the emulsion is set by cetane number consideration. Amounts of aqueous solution as high as 45 volume % may be used, but generally emulsions containing not more than 40 volume % of aqueous solution of alcohol are more suitable when the Diesel fuel is light fuel-oil. When the emulsion is prepared from gasoil, the amount of aqueous solution of alcohol should not generally exceed 35 volume %. When the emulsions are used for heating purposes, the calorific value is the main limitative factor and emulsions containing up to 45 volume % of aqueous solutions of alcohol may be employed. On the other hand, emulsions having a content in aqueous solution of alcohol lower than 5 volume % are not very attractive, as the fuel economy is negligible.

The HLB of the emulsifying blend plays also a role with respect to the emulsion stability. Preferably, the HLB of the emulsifying blend is at least 5, but generally does not exceed about 7 when the fuel to be emulsified is light fuel oil or even about 6.5 in case of gasoil. The type of emulsifying blend is also another factor and said blend preferably contains sorbitan monooleate together with a water-soluble, non ionic, ethoxylated surfactant. Illustrative surfactants include ethoxylated sorbitan monooleate containing from 20 to 40 moles of ethylene oxide (or E O); ethoxylated sorbitan monolaurate with 11–40 E O; ethoxylated nonylphenol with 8–50 E O; ethoxylated fatty alcohols with 6–50 E O; monooleate of polyethyleneglycol having a molecular weight comprised between about 480 and 1200. The selection of the surfactant depends upon some factors, such as availability, price and efficacity. The emulsion stability depends also on the type of fuel to be emulsified; by way of example, emulsions prepared from gasoil are more stable than similar emulsions prepared from light fuel oil when ethoxylated fatty alcohols are used as surfactants.

The required HLB may be reached by varying the respective amounts of sorbitan monooleate and surfactant. The amounts to be used will be easily determined by the skilled worker in the art.

The emulsion stability depends also upon the proportion of water in the aqueous solution of alcohol. This proportion varies according to the type of alcohol (methanol, ethanol or their mixtures) and the type of fuel to be emulsified. For the production of light fuel oil based emulsions, the volume percent of water in the aqueous solution is generally comprised between 45.7+0.229 S and 74.3, wherein S is the volume percent of ethanol based on the total volume of alcohol. For gasoil based emulsions, the volume percent of water in the aqueous solution is generally comprised between 43+0.20 S and 74. Aqueous solution of alcohol containing amounts of water lying outside these limits are generally less convenient for producing stable emulsions.

The process employed for producing the emulsions of this invention has been found to exercise an influence over the emulsion stability. According to a further embodiment of the present invention, the emulsions are produced by a process which comprises (i) preparing a first mixture of Diesel fuel and emulsifying blend, (ii) preparing the aqueous solution of alcohol, and (iii) adding, while stirring, said aqueous solution to the first mixture. Other methods of production present some drawbacks. For example, the addition of the first mixture to the aqueous solution of alcohol results in less stable emulsions. The addition of separate streams of water and alcohol to the first mixture requires the use of high shearing agitator, which induces an increase of the mixture temperature and some evaporation of the alcohol.

In order to more fully illustrate this invention, the following non-limitative examples are presented.

EXAMPLE 1

Various emulsions were prepared by adding while stirring an aqueous solution containing 15 cc methanol and 20 cc water to a mixture containing 61 cc light fuel oil and 4 cc of emulsifying blend.

The emulsifying blends were as follows:

A: sorbitan monooleate+ethoxylated sorbitan monooleate (20 E O)

B: sorbitan monooleate+ethoxylated sorbitan monolaurate (20 E O)

C: sorbitan monooleate+monooleate of polyethyleneglycol (M.W.: 600)

D: sorbitan monooleate+ethoxylated nonylphenol (15 E O)

The HLB of these blends were comprised between 4.3 and 8.5. These various HLB were obtained by varying the respective amounts of the components of these blends.

The stability of the obtained emulsions were determined 96 hours after their production. The results are given in the following Table 1.

TABLE 1

| Emulsifying blend | HLB Index 4.3 | 5 | 5.5 | 6 | 6.5 | 7 | 7.5 | 8 | 8.5 |
|---|---|---|---|---|---|---|---|---|---|
| A | + | ++ | ++ | ++ | ++ | ++ | + | − | − |
| B | + | ++ | ++ | ++ | ++ | ++ | + | − | − |
| C | + | ++ | ++ | ++ | ++ | ++ | ++ | − | − |
| D | + | ++ | ++ | ++ | ++ | ++ | ++ | − | − |

(++: stable; +: partial demixing; −: total demixing)

By way of comparison, the following emulsifying blends were used:

X: monooleate of polyethyleneglycol (MW 200)+monooleate of polyethyleneglycol (MW 600)

Y: ethoxylated fatty alcohol (2 E O)+ethoxylated fatty alcohol (5 E O)

Various blends wherein the respective amounts of surfactants were adjusted to cover a wide range of HLB were prepared. Emulsions were produced by using these blends, but they were not stable.

EXAMPLE 2

The procedure described in Example 1 was repeated for producing emulsions with various contents in emulsifying blends and various HLB.

The total volume of each emulsion was 100 cc and the compositions were the following:

methanol: 15 cc water: 20 cc emulsifying blend: from 1 to 10 cc (blend A of Example 1)

light fuel oil: from 55 to 64 cc

The results of the stability tests were as follows (Table 2).

TABLE 2

| HLB | Emulsifying blend (Volume %) 1 | 2 | 3 | 4 | 5 | 6 | 8 | 10 |
|---|---|---|---|---|---|---|---|---|
| 5 | − | − | ++ | ++ | ++ | ++ | ++ | ++ |
| 5.5 | − | − | ++ | ++ | ++ | ++ | ++ | ++ |
| 6 | − | − | ++ | ++ | ++ | ++ | ++ | ++ |
| 6.5 | − | − | ++ | ++ | ++ | ++ | ++ | ++ |
| 7 | − | − | ++ | ++ | ++ | ++ | ++ | ++ |

(++: stable after 98 hrs; −: demixing)

The same results were obtained by using the emulsifying blends B and C described in Example 1.

EXAMPLE 3

To a stirred mixture of 61 cc of light fuel oil and 4 cc of emulsifying blend A (HLB=6) was added an aqueous solution containing 15 cc of methanol and 20 cc water.

The resulting emulsion was stable after 96 hours.

Another portion of this emulsion was cooled during 96 hours at −20° C.; it remained stable.

By way of comparison, the same amounts of components were used, but other procedures were used:

(a) separate streams of methanol and water were added to the stirred mixture of fuel and emulsifying blend: total demixing after 72 hours (b) a mixture of fuel and emulsifying blend was added to the stirred aqueous solution of methanol: total demixing after 24 hours.

EXAMPLE 4

Various emulsions were prepared with different amounts of methanol and water, but the total volume of methanol+water was the same in each emulsion.

The emulsifying blend (blend A of Example 1) had a HLB of 6.

The compositions (in volume %) of the emulsions and the results of the stability tests are summarized in Table 3.

TABLE 3

| | | | | | | | | | |
|---|---|---|---|---|---|---|---|---|---|
| Light fuel oil | 61 | 61 | 61 | 61 | 61 | 61 | 61 | 61 | 57 |
| Emulsifying blend | 4 | 4 | 4 | 4 | 4 | 4 | 4 | 4 | 8 |
| Methanol | 7 | 8 | 9 | 16 | 17 | 18 | 19 | 20 | 20 |
| Water | 28 | 27 | 26 | 19 | 18 | 17 | 16 | 15 | 15 |

TABLE 3-continued

| | | | | | | | | | |
|---|---|---|---|---|---|---|---|---|---|
| Stability | − | − | ++ | ++ | ++ | ++ | ++ | − | − |

EXAMPLE 5

Various emulsions were prepared with different amounts of light fuel oil. For each emulsion, the amount of water in the aqueous solution of methanol was 57.1 volume %.

The emulsifying blend (blend A of Example 1) had a HLB of 6.

The compositions (in volume %) of the emulsions and the results of the stability tests are given in Table 4.

TABLE 4

| | | | | |
|---|---|---|---|---|
| Light fuel oil | 91 | 81 | 71 | 51 |
| Emulsifying blend | 4 | 4 | 4 | 4 |
| Methanol + water | 5 | 15 | 25 | 45 |
| Stability | ++ | ++ | ++ | ++ |

EXAMPLE 6

Various mixtures were prepared from 61 cc of light fuel oil and 4 cc of each of the emulsifying blends A to D described in Example 1. The HLB of these blends was comprised within the range from 4.3 to 8.5.

An aqueous solution of ethanol was prepared from 25 volume % of water and 10 volume % of ethanol.

The procedure described in Example 1 was used to prepare the emulsions; the total volume of each emulsion was 100 cc.

The results of the stability tests (after 96 hours) are given in Table 5.

TABLE 5

| Emulsifying blend | HLB | | | | | | | | |
|---|---|---|---|---|---|---|---|---|---|
| | 4.3 | 5 | 5.5 | 6 | 6.5 | 7 | 7.5 | 8 | 8.5 |
| A | − | ++ | ++ | ++ | ++ | ++ | − | − | − |
| B | − | ++ | ++ | ++ | ++ | ++ | − | − | − |
| C | − | ++ | ++ | ++ | ++ | ++ | − | − | − |
| D | − | ++ | ++ | ++ | ++ | ++ | − | − | − |

EXAMPLE 7

Various emulsions were prepared from light fuel oil, emulsifying blend A of Example 1 (HLB: from 5 to 7), water and ethanol. The total volume of each emulsion was 100 cc. The emulsions contained 25 cc of water, 10 cc of ethanol, from 1 to 10 cc of emulsifying blend and respectively from 54 to 64 cc of fuel.

The results with respect to stability are given in Table 6.

TABLE 6

| | Emulsifying blend (vol. %) | | | | | | | |
|---|---|---|---|---|---|---|---|---|
| HLB | 1 | 2 | 3 | 4 | 5 | 6 | 8 | 10 |
| 5 | − | − | ++ | ++ | ++ | ++ | ++ | ++ |
| 5.5 | − | − | ++ | ++ | ++ | ++ | ++ | ++ |
| 6 | − | − | ++ | ++ | ++ | ++ | ++ | ++ |
| 7 | − | − | ++ | ++ | ++ | ++ | ++ | ++ |

EXAMPLE 8

Various emulsions were prepared from light fuel oil, emulsifying blend A of Example 1 (HLB=7) and an aqueous solution of ethanol (volume % of water: 73.4).

The compositions (volume %) and results of stability tests are given in Table 7.

TABLE 7

| | | | | |
|---|---|---|---|---|
| Light fuel oil | 91 | 81 | 71 | 51 |
| Emulsifying blend | 4 | 4 | 4 | 4 |
| Aqueous solution of ethanol | 5 | 15 | 25 | 45 |
| Stability | ++ | ++ | ++ | ++ |

EXAMPLE 9

Various emulsions were prepared by using aqueous solutions containing methanol and ethanol.

The respective volumes of the components and the results of the stability tests are given in Table 8.

TABLE 8

| Experiment | 1 | 2 | 3 | 4 | 5 | 6 | 7 | 8 |
|---|---|---|---|---|---|---|---|---|
| Light fuel oil | 61 | 61 | 61 | 61 | 61 | 61 | 61 | 61 |
| Emulsifying blend A (HLB = 7) | 4 | 4 | 4 | 4 | 4 | 4 | 4 | 4 |
| Methanol | 16.6 | 14.0 | 14.0 | 10.5 | 7 | 1.75 | 1.75 | 3.5 |
| Ethanol | 0.9 | 1.75 | 3.5 | 1.75 | 3.5 | 7 | 8.75 | 10.5 |
| Water | 17.5 | 19.25 | 17.5 | 22.75 | 24.5 | 26.25 | 24.5 | 21 |
| Stability | ++ | ++ | − | ++ | ++ | ++ | ++ | − |

Experiments 3 and 8 are comparative experiments. The amount of water is lower than the required minimum amount. In experiment 3, the amount of water in the aqueous solution of alcohols is 50% and the minimum should be 45.7+(0.229×20) or 50.28%. In experiment 8, the amount of water in the aqueous solution of alcohols is 60% and the minimum should be 45.7+(0.229×75) or 62.87%.

EXAMPLE 10

Various emulsions were prepared. For each emulsion, a mixture of 36 cc of methanol and 16 cc of water was added, while stirring, to a mixture containing 64 cc of gasoil and 4 cc of emulsifying blend.

The used emulsifying blends were blends A to D of Example 1 and blend E containing sorbitan monooleate and ethoxylated fatty alcohol (9 E O). The HLB of these blends (from 5 to 12) were obtained by varying the respective amounts of components.

The results are given in Table 9.

TABLE 9

| Emulsifying blend | 5 | 5.5 | 6 | 6.5 | 7 | 8 | 10 | 12 |
|---|---|---|---|---|---|---|---|---|
| A | ++ | ++ | ++ | ++ | + | − | − | − |
| B | ++ | ++ | ++ | ++ | + | − | − | − |
| C | ++ | ++ | ++ | ++ | + | − | − | − |
| D | ++ | ++ | ++ | ++ | + | − | − | − |
| E | ++ | ++ | ++ | ++ | + | − | − | − |

(++: stable after 96 hours; +: partial demixing; −: total demixing)

By way of comparison, the following emulsifying blends were used to prepare similar emulsions.

F: sorbitan monooleate+monooleate of polyethyleneglycol (MW: 300) (not soluble in water)

G: sorbitan monooleate+ethoxylated nonylphenol (4 E O) (insoluble)

H: sorbitan monooleate+ethoxylated fatty alcohol (3 E O) (insoluble)

I: sorbitan monolaurate+ethoxylated sorbitan monolaurate (20 E O) (soluble)

J: monooleate of polyethyleneglycol (MW: 200)+monooleate of polyethyleneglycol (MW: 600) (soluble)

K: ethoxylated nonylphenol (4 E O)+ethoxylated nonylphenol (15 E O)

L: ethoxylated fatty alcohol (3 E O)+ethoxylated fatty alcohol (9 E O)

The emulsions prepared by using these emulsifying blends were not stable.

EXAMPLE 11

An emulsion was prepared from gasoil (64 volume %), emulsifying blend A of Example 1 (4 volume %), methanol (16 volume %) and water (16 volume %).

The cetane numbe of the emulsion was 26.

The emulsion was used to feed a Diesel engine.

A road test (80 km) was carried out and the emulsion consumption was 48.3 liters or a gasoil consumption of 30.9 liters. The same test was conducted but by feeding the Diesel engine with gasoil: the consumption was 39.3 liters.

EXAMPLE 12

Emulsions containing different amounts of emulsifying blend (blend A; HLB varying from 5.5 to 6.5) were prepared.

Each emulsion had a total volume of 100 cc. It contained 22.5 cc of water and 12.5 cc of ethanol. The amount of emulsifying was varying between 1 and 10 cc and the amount of gasoil was varying between 55 and 64 cc.

The results of the stability tests are given in Table 10.

TABLE 10

| | Emulsifying blend (volume %) | | | | | | | |
|---|---|---|---|---|---|---|---|---|
| HLB | 1 | 2 | 3 | 4 | 5 | 6 | 8 | 10 |
| 5.5 | – | – | ++ | ++ | ++ | ++ | ++ | ++ |
| 6 | – | – | ++ | ++ | ++ | ++ | ++ | ++ |
| 6.5 | – | – | ++ | ++ | ++ | ++ | ++ | ++ |

I claim:

1. Diesel fuel emulsions of the water-in-oil type comprising from about ninety-seven to about ninety volume percent of a mixture comprising a major amount of usual diesel fuel and a minor amount of at least about five volume percent, based on the volume of the emulsion, of an aqueous solution of an alcohol selected from the group consisting of methanol, ethanol, and mixtures thereof, and from about three to about ten volume percent of an emulsifying blend consisting essentially of sorbitan monooleate and a water soluble, ethoxylated, non-ionic surfactant, said emulsifying blend having a hydrophilic-lipophilic balance ranging from about 5 to 7.

2. Diesel fuel emulsions according to claim 1, comprising from about fifty-five to about ninety-two volume percent of gasoil, from about five to about thirty-five volume percent of an aqueous solution comprising an alcohol selected from the group consisting of methanol, ethanol, and mixtures thereof, the volume percentage of water in said solution ranging from about forty-three plus 0.20 S and seventy-four, wherein S is the volume percent of ethanol based on the total volume of alcohol, and from about three to about ten percent by volume of emulsifying blend having a HLB ranging from about five to about 6.5.

3. Diesel fuel emulsion according to claim 1 wherein the surfactant is selected from the group consisting of ethoxylated sorbitan monooleate containing from 20 to 40 moles of ethylene oxide, and ethoxylated sorbitan monolaurate containing from 11 to 40 moles of ethylene oxide, and ethoxylated nonylphenol containing from 8 to 50 moles of ethylene oxide, and ethoxylated fatty alcohol containing from 6 to 50 moles of ethylene oxide, and a monooleate of polyethyleneglycol having a molecular weight ranging from about 480 to about 1200.

4. Diesel fuel emulsions according to claim 1, comprising from about 45 to about 92 volume percent of light fuel oil, from about 5 to about 45 volume percent of an aqueous solution comprising an alcohol selected from the group consisting of methanol, ethanol, and mixtures thereof, the volume percentage of water in said solution ranging from about 45.7 plus 0.229 S and 74.3, wherein S is the volume percentage of ethanol based on the total volume of alcohol, and from about 3 to about 10 volume percent of emulsifying blend having a HLB ranging from about 5 to about 7.

5. Diesel fuel emulsions according to claim 4, wherein the surfactant is selected from the group consisting of an ethoxylated sorbitan monooleate containing from 20 to 40 moles of ethylene oxide, and ethoxylated sorbitan monolaurate containing 11 to 40 moles of ethylene oxide, and ethoxylated nonylphenol containing 8 to 50 moles of ethylene oxide, and a monooleate of polyethyleneglycol having a molecular weight ranging from about 480 to 1200.

6. A process for producing the emulsions of claim 1 comprising the step of adding while stirring the aqueous solution of alcohol to a mixture of fuel and emulsifying blend.

7. A process for producing the emulsions of claim 2, comprising the step of adding while stirring the aqueous solution of alcohol to a mixture of fuel and emulsifying blend.

8. A process for producing the emulsion of claim 3, comprising the step of adding while stirring the aqueous solution of alcohol to a mixture of fuel and emulsifying blend.

9. A process for producing the emulsion of claim 4, comprising the step of adding while stirring the aqueous solution of alcohol to a mixture of fuel and emulsifying blend.

10. A process for producing the emulsion of claim 5, comprising the step of adding while stirring the aqueous solution of alcohol to a mixture of fuel and emulsifying blend.

* * * * *